US009170525B2

(12) United States Patent
Adachi et al.

(10) Patent No.: US 9,170,525 B2
(45) Date of Patent: Oct. 27, 2015

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Motoki Adachi, Ashigarakami-gun (JP); Takuya Kitamura, Yokohama (JP); Hideo Kihara, Yokohama (JP); Kouki Yano, Kawasaki (JP); Yuta Isobe, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/269,462

(22) Filed: May 5, 2014

(65) Prior Publication Data

US 2014/0334853 A1 Nov. 13, 2014

(30) Foreign Application Priority Data

May 7, 2013 (JP) ..... 2013-097599
Apr. 8, 2014 (JP) ..... 2014-079686

(51) Int. Cl.
*G03G 15/08* (2006.01)

(52) U.S. Cl.
CPC ..... *G03G 15/0812* (2013.01)

(58) Field of Classification Search
CPC ..... G03G 15/0812; G03G 2215/0641
See application file for complete search history.

(56) References Cited

U.S. PATENT DOCUMENTS

| | | | | |
|---|---|---|---|---|
| 4,271,249 | A * | 6/1981 | Gilliams et al. | 430/101 |
| 4,632,535 | A * | 12/1986 | Nagata | 399/283 |
| 7,912,390 | B2 * | 3/2011 | Mitsui | 399/61 |
| 2003/0223783 | A1 * | 12/2003 | Yamamoto et al. | 399/284 |

FOREIGN PATENT DOCUMENTS

JP H06-301281 A 10/1994

* cited by examiner

*Primary Examiner* — Sandra Brase
(74) *Attorney, Agent, or Firm* — Fitzpatrick, Cella, Harper & Scinto

(57) ABSTRACT

A developing device usable with an image forming apparatus includes a developer carrying member for carrying a developer, a developer accommodating portion for accommodating a developer, and a guiding member having an inclined surface contacting the developer carrying member. The inclined surface guides a developer to a contact portion where the inclined surface contacts the developer carrying member to cause the developer to be carried on the developer carrying member. A regulating member regulates an amount of the developer carried on the developer carrying member. An inclination angle of the inclined surface is in a range not less than an angle of rest of the developer and less than 90 degrees.

18 Claims, 6 Drawing Sheets

DEVELOPING DEVICE, PROCESS CARTRIDGE, AND IMAGE FORMING APPARATUS

FIELD OF THE INVENTION AND RELATED ART

The present invention relates to image forming apparatuses, such as copying machine, printers, etc., which are provided with a function for forming an image on a sheet of recording medium. In particular it relates to a developing device and a process cartridge with which these image forming apparatuses are provided.

It has been known that some conventional developing devices are configured as follows: They are made up of a development roller, a supply roller, a regulating member, a toner container, etc. The development roller bears developer, and develops an electrostatic latent image formed on a photosensitive member. The regulating member regulates in thickness the layer of developer on the development roller. The toner container stores toner (Japanese Laid-open Patent Application H06-301281).

The supply roller is placed in contact with the development roller in such a manner that it is compressed by a reset amount by the development roller. It rotates in the same direction as the development roller. Conventionally, a sponge roller made up of a metallic core, and a layer of sponge which covers the peripheral surface of the metallic core is used as the supply roller. In a case where a sponge roller is used as the supply roller, developer is taken up by the sponge layer of the sponge roller, and is conveyed to the area of contact, between the development roller and sponge roller, in which the sponge layer of the sponge roller is compressed by the development roller. Consequently, the developer in the sponge layer is discharged, being thereby supplied to the development roller.

In recent years, users of an image forming apparatus have become increasingly concerned with the environment. Thus, it has become important to use the developer in a toner container as completely as possible. However, there has been a concern that in the case of the conventional configuration for a developing device, the developer in the portion of the sponge layer which is in the adjacencies of the metallic core of the sponge roller will fail to be discharged from the sponge layer to be supplied to the development roller. In order to reduce the sponge roller in the amount by which the developer fails to be delivered from the development roller to be used for development, it is necessary not to use the sponge roller to supply the development roller with developer.

SUMMARY OF THE INVENTION

The present invention was made in consideration of an issue such as the above-described one. Thus, the primary object of the present invention is to increase a developer supply roller in the ratio with which the developer in the roller can be discharged to be used for development.

According to an aspect of the present invention, there is provided a developing device usable with an image forming apparatus, comprising a developer carrying member for carrying a developer; a developer accommodating portion for accommodating a developer; a guiding member having an inclined surface contacting said developer carrying member, said inclined surface being effective to guide a developer to a contact portion where the inclined surface contacts said developer carrying member to cause the developer to be carried on said developer carrying member; and a regulating member for regulating an amount of the developer carried on said developer carrying member, wherein an inclination angle of said inclined surface is in a range not less than an angle of rest and less than 90 degrees.

Further features of the present invention will become apparent from the following description of exemplary embodiments with reference to the attached drawings.

DESCRIPTION OF THE PREFERRED EMBODIMENTS

Hereinafter, a few of the preferred embodiments of the present invention are described with reference to the appended drawings. However, the measurements, materials, and shapes of the structural components of the developing device, and the positional relationship among the structural components, in the following embodiments of the present invention, are not intended to limit the present invention in these properties. That is, they are to be modified as necessary according to the configuration of the device to which the present invention is applied, and also, according to the condition under which the device is used. The present invention relates to a developing apparatus employed by an electrophotographic apparatus, an electrostatic recording apparatus, and the like to develop an electrostatic latent image (into visible image), with the use of developer.

[Embodiment 1]

Next, the first embodiment of the present invention is described.

<Image Forming Apparatus>

Figure 2:
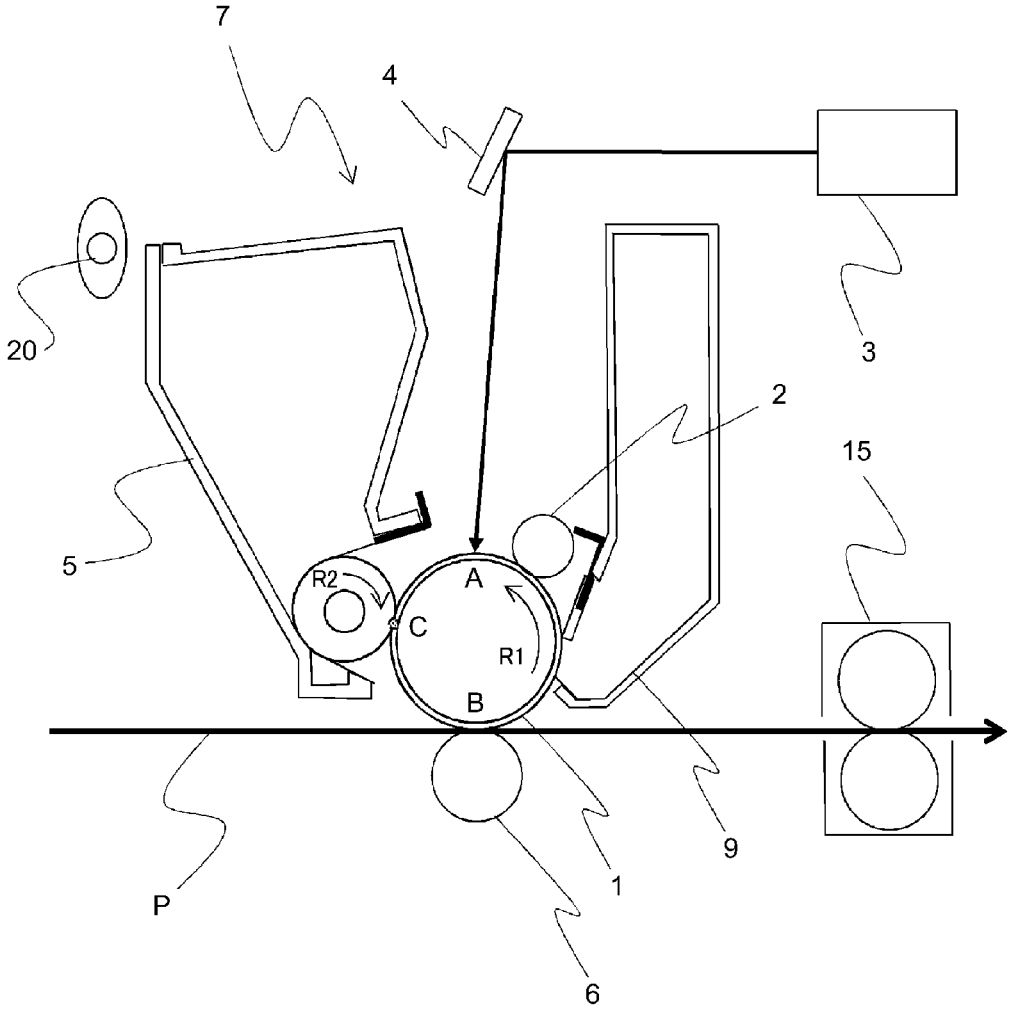
FIG. 2 is a schematic sectional view of the image forming apparatus in the first embodiment.

FIG. 2 is a schematic sectional view of the image forming apparatus in this embodiment. Referring to FIG. 2, the image forming apparatus is provided with a photosensitive drum 1, as an image bearing member, which is rotatable in the direction indicated by an arrow mark R1. The image forming apparatus is also provided with a charge roller 2, a developing device (development unit) 5, a transfer roller 6, and a cleaning device 9, which are disposed in the listed order in terms of the direction indicated by the arrow mark R1 in FIG. 2. The photosensitive drum 1, charge roller 2, developing device 5, and cleaning device 9 are integrally placed in a cartridge, forming thereby a process cartridge 7 which is removably installable in the main assembly of the image forming apparatus. Further, the image forming apparatus is provided with an exposing device 3, which forms an electrostatic latent image on the peripheral surface of the photosensitive drum 1 by emitting a beam of laser light in such a manner that the beam is projected upon points of exposure (which are on downstream side of charge roller 2 and upstream side of developing device 5) on the photosensitive drum 1, by way of a deflection mirror 4.

With the image forming apparatus being structured as described above, as the photosensitive drum 1 is rotated, the charging, exposing, developing, and cleaning processes are sequentially carried out for numerous points of the peripheral surface of the photosensitive drum 1 (detailed description of these processes is given later).

The charge roller 2 is for uniformly charging the peripheral surface of the photosensitive drum 1. The developing device 5 is for storing toner (developer), and developing an electrostatic latent image formed on the peripheral surface of the photosensitive drum 1 (puts photosensitive drum 1 through development process), into a toner image (visible image formed of toner). That is, a part of the internal space of the developing device 5 is the developer storage (toner storage).

The developing device 5 is structured so that it can be removably installable in the main assembly of the image forming apparatus. The transfer roller 6 is for transferring a toner image formed on the peripheral surface of the photosensitive drum 1, onto a sheet P of recording medium. The cleaning device 9 is for removing the toner which failed to be transferred onto a sheet P of recording medium, being therefore remaining on the photosensitive drum 1 after the transfer. It is provided with a cleaning blade, which is placed in contact with the peripheral surface of the photosensitive drum 1 to scrape away the toner from the peripheral surface of the photosensitive drum 1.

Further, the image forming apparatus is provided with a fixing device 15 which applies heat and pressure to the sheet P of recording medium and the toner image thereon to fix the toner image to the sheet P, after the transfer of the toner image onto the sheet P.

<Image Forming Process>

Next, the image forming operation of the image forming apparatus in this embodiment is described.

First, referring to FIG. 2, the photosensitive drum 1 is rotated in the direction indicated by an arrow mark R1 at 100 mm/sec. As the photosensitive drum 1 is rotated, the peripheral surface of the photosensitive drum 1 is charged by the charge roller 2 to a preset potential level. Then, a beam of laser light is emitted by the exposing device 3, while being modulated with image formation signals which correspond to color components of the image to be formed, so that the beam of laser light is projected upon the points of the photosensitive drum 1, which correspond to the exposing position A of the image forming apparatus. Consequently, an electrostatic image is effected upon the peripheral surface of the photosensitive drum 1. The electrostatic latent image formed on the peripheral surface of the photosensitive drum 1 is developed by the developing device 5 in the development position C shown in FIG. 2. Consequently, a toner image is formed on the peripheral surface of the photosensitive drum 1. The toner image formed on the photosensitive drum 1 is transferred onto a sheet P of recording medium, by the transfer roller 6, in the transfer position B shown in FIG. 2. After the transfer of the toner image onto the sheet P, the sheet P is sent to the fixing device 15, in which the sheet P and the toner image thereon are subjected to heat and pressure. Consequently, the toner image on the sheet P becomes fixed to the sheet P. This is how an image is formed on the sheet P.

<Developing Device>

Figure 1:
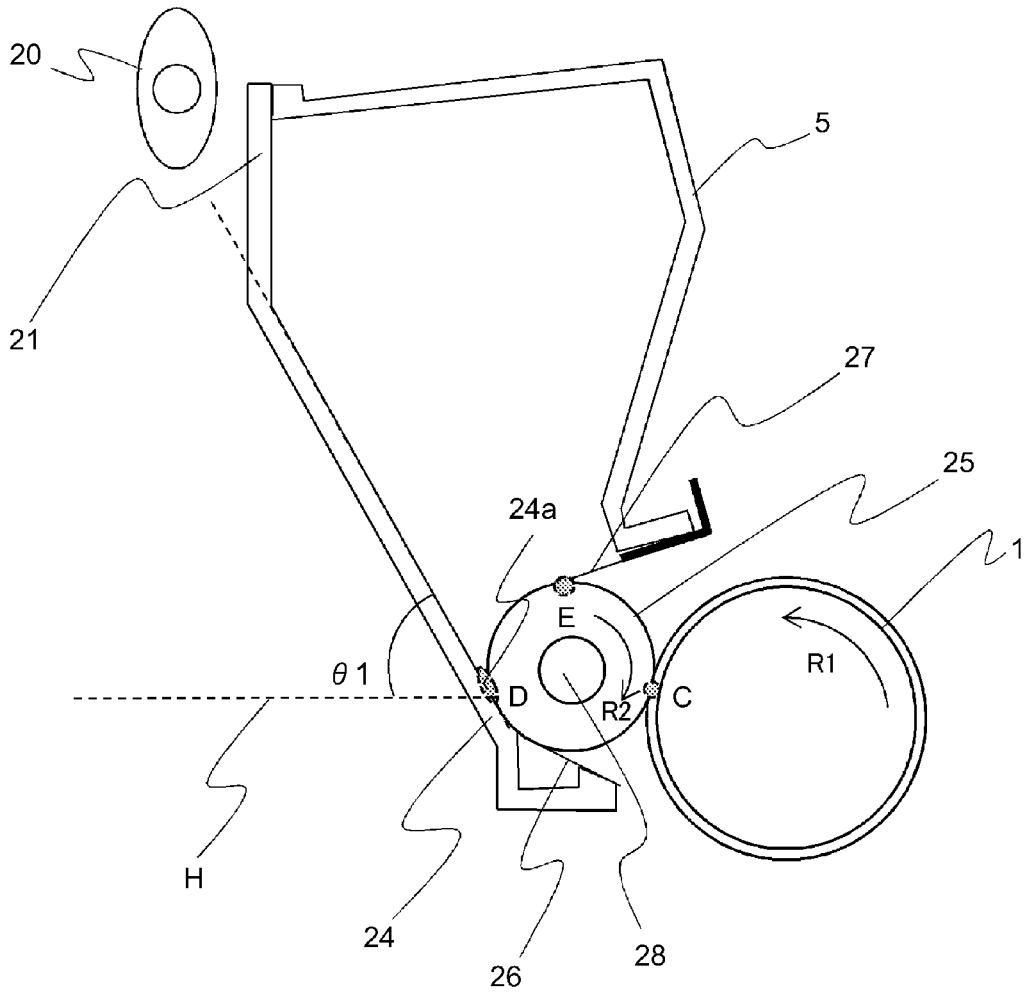
FIG. 1 is a schematic sectional view of the developing device in the first embodiment of the present invention. It is for describing the structure of the developing device.

FIG. 1 is a schematic sectional view of the developing device 5 in this embodiment. It is for describing the structure of the developing device 5.

The developing device 5 is provided with a development roller 25 which is a developer bearing member, a regulation blade 27 which is a regulating member, and a toner guiding member 24 which is a guiding member. The developer container 21 is for storing toner. It is equivalent to a toner storage. The development roller 25 is for bearing toner. It is positioned so that it faces the opening of the developer container 21, which is at the bottom of the developer container 21. The regulation blade 27 is for controlling the amount, per unit area, by which toner is allowed to remain on the peripheral surface of the development roller 25, that is, for controlling in thickness the layer of toner on the peripheral surface of the development roller 25. The toner guiding member 24 is positioned so that it contacts the peripheral surface of the development roller 25.

By being structured as described above, the developing device 5 supplies the peripheral surface of the photosensitive drum 1 with the toner in the layer of toner borne by the development roller 25 while being regulated in thickness by the regulation blade 27.

During a developing operation, the development roller 25 rotates in contact with the photosensitive drum 1. After the completion of the developing operation, a cam 20 with which the main assembly of the image forming apparatus is provided is rotated. As the cam 20 is rotated, it presses the top portion of the developer container 21, causing thereby the development roller 25 to be separated from the photosensitive drum 1. After the separation of the development roller 25 from the photosensitive drum 1, the controlling means of the main assembly of the image forming apparatus stops the rotation of the development roller 25. That is, while the developing device 5 is used to develop the latent image on the photosensitive drum 1, the development roller 25 is kept in the position and attitude (first position in FIG. 1), in which it is kept in contact with the photosensitive drum 1. On the other hand, while the developing device 5 is not used for developing the latent image on the photosensitive drum 1, it is kept in the position and attitude (second position in FIG. 6), in which the development roller 25 is kept separated from the photosensitive drum 1).

The development roller 25 comprises: an electrically conductive metallic core 28, which is 8 mm in diameter; and an electrically conductive elastic layer formed of rubber, around the metallic core 28; and a surface layer formed of acrylic rubber, urethane rubber, or the like, in a manner to cover the elastic layer. The development roller 25 is 13 mm in external diameter, and roughly 105Ω·cm in volume resistivity. The development roller 25 is supported by the developer container 21 so that during a developing operation, it contacts the photosensitive drum 1 in a development position C, and can be rotationally driven in the direction indicated by the arrow mark R2 shown in FIG. 1. During a developing operation, the development roller 25 is 10 mm/sec in peripheral velocity.

The regulation blade 27 is made of a flexible sheet of stainless steel (SUS). It is attached to a supporting plate, by one of its long edge portions, in such a manner that its free edge portion (other long edge portion) remains in contact with the peripheral surface of the development roller 25. The supporting plate is fixed to the developer container 21. The regulation blade 27 is disposed in such an attitude that its long edge portion by which it is held to the supporting plate is on the downstream side of its unattached (free) long edge portion which is in contact with the peripheral surface of the development roller 25, in terms of the rotational direction (indicated by arrow mark R2), and also, that the flat and smooth surface portion of the adjacencies of the unattached (free) edge portion rubs the peripheral surface of the development roller 25, in an area where the toner layer on the peripheral surface of the development roller 25 is regulated in the amount per unit area. In addition, the developing device 5 is provided with a leakage prevention seal 26, which keeps sealed the gap between the development roller 25 and developer container 21.

The toner guiding member 24, which is one of the structural components of the developing device 5 that characterize this embodiment is an extension of the wall of the developer container 21. It is positioned so that it contacts the peripheral surface of the development roller 25 in a toner supply position D shown in FIG. 1. To describe in detail, the toner guiding member 24 is for guiding toner to the area of contact (toner supply position D) between the development roller 25, and the slanted surface 24*a* by which it contacts the development roller 25, with the use of the slanted surface 24*a*. The amount of apparent intrusion of the toner guiding member 24 into the development roller 25 is 0.04 mm, and the angle θ1 of the toner guiding member 24 relative to the horizontal plane H (horizontal line in FIG. 1) is 70 degrees. Referring to FIG. 1, an angle θ1 is the angle which the horizontal plane H and the slanted surface 24*a* of the toner guiding blade 24 form, without the presence of the development roller 25 between the horizontal plane H and slanted surface 24*a*.

<Development Process>

The toner stored in the developer container 21 is guided to the toner supply position D along the toner guiding member 24, and is supplied to the development roller 25 so that it adheres to the peripheral surface of the development roller 25. As the toner adheres to the peripheral surface of the development roller 25, it is conveyed to the toner amount regulation position E, shown in FIG. 1, by the rotation of the development roller 25, and is regulated by the regulation blade 27 so that a toner layer, which is proper in thickness (amount per unit area) is formed on the peripheral surface of the development roller 25. Then, the toner coated on the peripheral surface of the development roller 25 is used to develop (into visible image) the electrostatic latent image formed on the peripheral surface of the photosensitive drum 1, in the development position C. The toner which was not used for development, and therefore, is remaining on the peripheral surface of the development roller 25 after the development, is returned to the interior of the developer container 21.

<Toner Supply Process>

Figure 3:
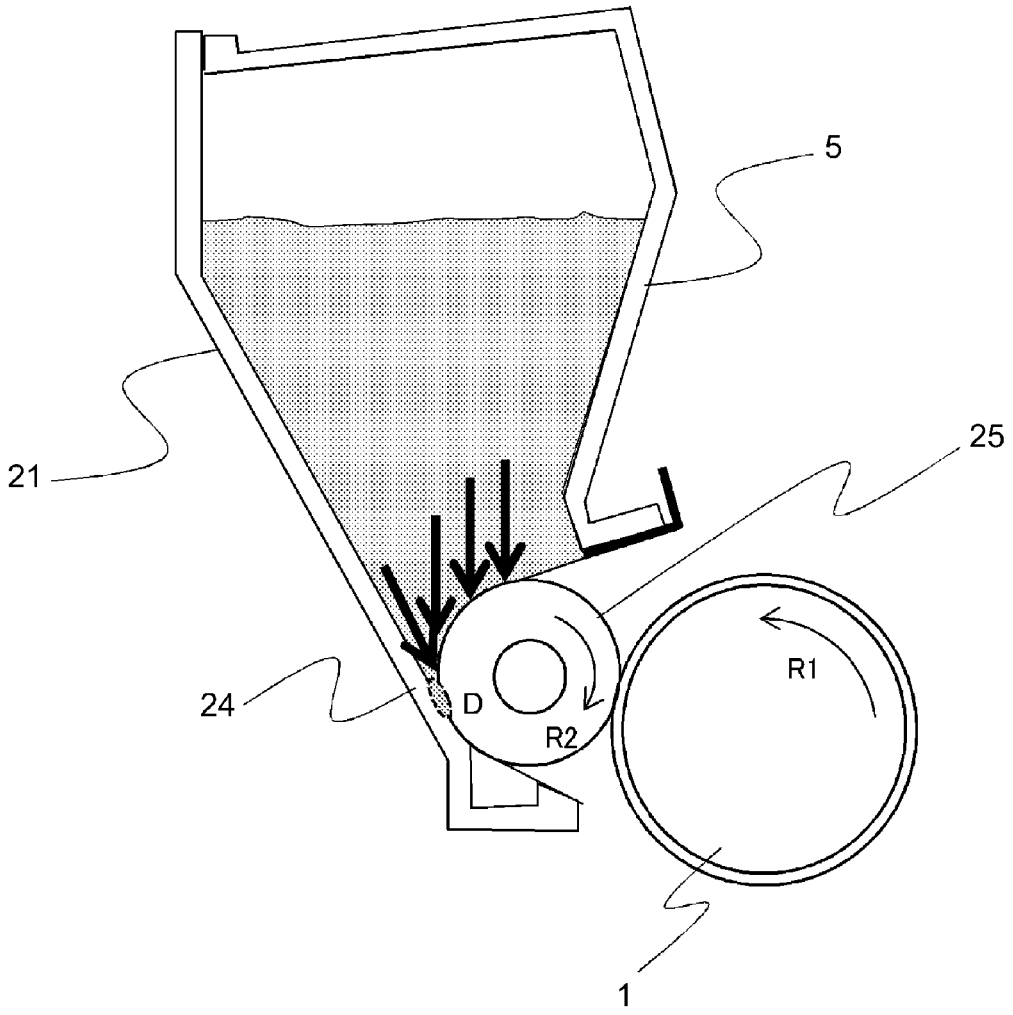
FIG. 3 is a schematic sectional view of the portions of the developing device in the first embodiment, which are essential for describing the method for supplying the development roller with toner.

Next, referring to FIGS. 2 and 3, the method for supplying the development roller 25 with toner, with use of the toner guiding member 24, is described. FIG. 3 is a schematic sectional view of the portions of the developing device 5, which are essential for supplying the development roller 25 with toner. It is for describing the method for supplying the development roller 25 with toner. Hereafter, "upward or downward direction" of the image forming apparatus (developing device) means the vertical direction of the apparatus when the apparatus is positioned for image formation.

The inventors of the present invention discovered that in order to satisfactorily supply the development roller 25 with toner, it is necessary for a large amount of toner to come into contact with the development roller 25. Further, the inventors thought that in order to increase the developing device 5 in the frequency with which the toner (toner particles) comes into contact with the development roller 25, the developing device 5 needs to be structured so that the toner is given such a force that makes the toner move toward the development roller 25.

In this embodiment, therefore, the developing device 5 is structured (shaped) so that the toner is stored on the top side of the development roller 25, and gravity (weight of toner itself) is used to deliver the toner onto the peripheral surface of the development roller 25. Further, in order to improve the developing device 5 in the efficiency with which toner is given the force which makes the toner move toward the development roller 25, the toner guiding member 24 is placed in contact with the peripheral surface of the development roller 25.

As described above, the toner guiding member 24 is disposed in contact with the development roller 25 in such an attitude that the angle θ between the horizontal plane H and the slanted surface 24*a* of the toner guiding member 24 becomes 70 degrees. This angle is no less than the angle of repose of toner. Therefore, the toner is smoothly guided to the area of contact (toner supply position D) between the development roller 25 and the toner guiding member 24. While the toner is guided by the toner guiding member 24, the vector attributable to the weight of toner itself is directed by the toner guiding member 24 toward the development roller 25. In addition, the toner is subjected to the downward force generated by its own weight. Therefore, the toner is compressed by its own weight, being thereby increased in density.

For the reason described above, the toner is placed in the condition in which it is pressed upon the peripheral surface of the development roller 25, and therefore, the developing device 5 is increased in the frequency with which toner (toner particles) comes into contact with the development roller 25, being thereby ensured that the toner adheres to the development roller 25.

Figure 4:
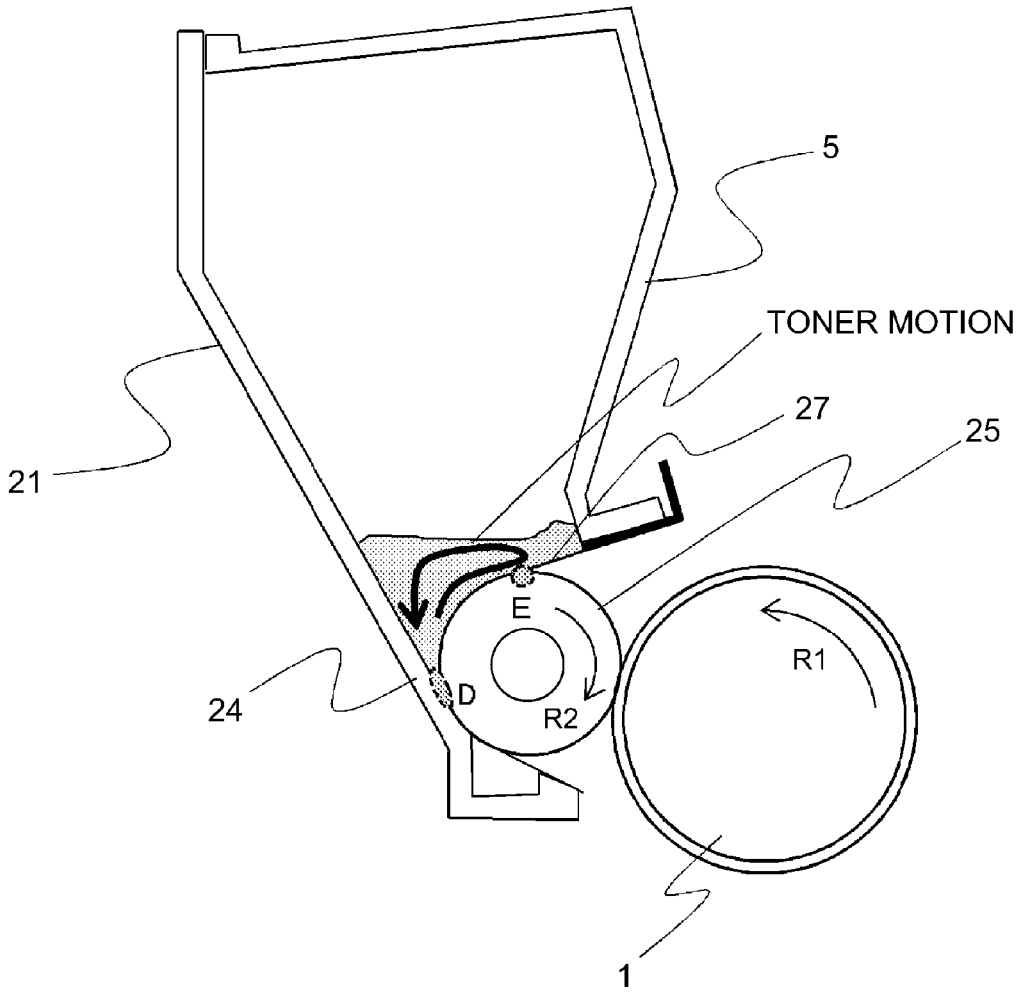
FIG. 4 is a schematic sectional view of the portions of the developing device in the first embodiment, which are essential for describing how the toner in the developer container flows to be supplied to the development roller when the amount of the toner in the developer container is small.

FIG. 4 is a schematic sectional view of the portions of the developing device 5, which are essential to the toner flow in the developer container 21. It shows the toner flow when the amount of toner in the developer container 21 is small; the toner is in only the bottom portion of the developer container 21.

In this embodiment, the toner amount regulation position E is on the top side of the toner supply position D. Referring to FIG. 4, therefore, as the toner is conveyed to the toner amount regulation position E by the development roller 25, it is removed from the development roller 25 by the regulation blade 27, and is moved to the toner supply position D by its own weight (movement indicated by arrow mark in FIG. 4). Thus, it is ensured that a certain amount of toner is always present in the toner supply position D. Therefore, even if the amount of the toner in the developer container 21 becomes very small, it is possible to reliably supply the development roller 25 with toner.

As described above, according to this embodiment, it is possible to reliably supply the development roller 25 with toner, without using a toner supply roller with which conventional developing devices are provided to supply the development roller 25 with toner, and which has the sponge layer.

Further, because the development roller 25 having a sponge layer is not used, the problem that a certain amount of toner is wasted by penetrating into the portion of the sponge layer, which is in the adjacencies of the metallic core of the development roller 25, and failing to be moved out of the sponge layer, does not occur. Therefore, the toner in the developer container 21 is not wasted. Further, because the developing device 5 in this embodiment does not employ a toner supply roller, it is substantially less expensive than developing apparatuses which employ a toner supply roller. That is, the present invention makes it possible to provide a developing device which is substantially more inexpensive than a developing device which employs a toner supply roller.

Further, because the developing device 5 in this embodiment does not employ a developer supply roller, it is substantially smaller in size than a developing device which employs a developer supply roller. That is, the present invention can provide a developing device which is substantially smaller in size than a developing device which employs a developer supply roller.

In this embodiment, the angle θ1 which the slanted surface 24*a* of the toner guiding member 24 and the horizontal plane H form was 70 degrees. However, this embodiment is not intended to limit the present invention in terms of the angle between the slanted surface 24*a* and the horizontal plane H. That is, the toner used by the developing device 5 in this embodiment is 30-45 in the angle of repose. Therefore, as long as the angle θ1 which the slanted surface 24*a* of the toner guiding member 24 and the horizontal plane H form is no less than 45 degrees, this embodiment is effective. However, if the angle θ1 is no less than 90 degrees, the above-described force which causes the toner to move toward the development roller 25 is unlikely to be generated. Thus, in order to ensure that the toner guiding member 24 is effective, the developing device 5 has to be structured so that the angle θ1 becomes no more than 90 degrees. However, the smaller the angle θ1, the smaller the force which causes the toner to move toward the development roller 25. This is why the angle θ1 is set to be no less than the angle of repose of toner (developer).

Further, after the separation of the development roller 25 from the photosensitive drum 1, the angle θ which the slanted surface 24*a* and horizontal plane H form is greater by roughly 10 degree than the angle θ1. Thus, in order to ensure that the development roller 25 is smoothly provided with toner at the beginning of a developing operation, it is desired that the angle between the slanted surface 24*a* and horizontal plane H is no more than 90 degree even after the separation of the development roller 25 (developing device) from the photosensitive drum 1.

In this embodiment, therefore, the angle θ1 is set to 70 degrees, which is thought to be the optimal angle in consideration of above described concerns.

Next, the angle of repose of toner is described. "Angle of repose of toner" is the angle of the generatrix of the cone which toner forms as it is allowed to free fall onto the horizontal plane. In this embodiment, the angle of repose of the toner was measured with the use of a power-tester PT-S (Hosokawa Micron Co., Ltd.). More specifically, 150 g of toner was placed on a sieve which is 250 μm in mesh size, and was subjected to vibrations to cause the toner to accumulate on a round table, which is 8 cm in diameter, through a funnel, in such a manner that the toner overflows at the edge of the table. Then, the angle which the generatrix of the cone-shaped pile of toner and the surface of the round table was measured. The thus obtained angle is the angle of repose of toner.

The toner used by the developing device 5 in this embodiment is non-magnetic single-component developer which is spherical in particle shape. Toner which is spherical in particle shape is relatively small in angle of repose. Thus, it can be easily delivered to the toner supply position D. This embodiment is not intended to limit the present invention in term of developer (toner) type. That is, the application of the present invention is not limited to a developing device which uses nonmagnetic single-component toner which is spherical in particle shape. That is, all that is necessary for the present invention to be applicable to a given developing device is that the developing device uses such toner that can be guided to the toner supply position D by the slanted surface 24*a* of the toner guiding member 24 to be borne by the development roller 25.

Further, in this embodiment, the amount of apparent intrusion of the toner guiding member 24 into the development roller 25 was 0.04 mm. However, this embodiment is not intended to limit the present invention in the amount of apparent intrusion of the toner guiding member 24 into the development roller 25. That is, this amount of apparent intrusion is to be set to ensure that the toner guiding member 24 remains in contact with the development roller 25, in consideration of the error in the external diameter of the development roller 25, and the accuracy with which the toner guiding member 24 is positioned. Further, in this embodiment, the development roller 24 is provided with the elastic layer. Therefore, as long as the amount of apparent intrusion is roughly 0.04 mm, the contact pressure between the toner guiding member 24 and development roller 25 can be absorbed by the deformation of the elastic layer.

Further, the material of the toner guiding member 24 in this embodiment is polystyrene, which is the same as the material of the developer container 21. However, this embodiment is not intended to limit the present invention in terms of the material for the toner guiding member 24. That is, the material for the toner guiding member 24 may be resinous plastic other than polystyrene.

Further, in this embodiment, the angle θ1 was set in consideration of the period in which the developer roller 25 is kept separated from the photosensitive drum 1. That is, the developing device 5 was structured so that the angle θ between the slanted surface 24*a* and horizontal plane Y would be no more than 90 degrees (and no less than angle of repose of toner) whether the development roller 25 was in contact with, or kept separated from, the photosensitive drum 1.

Figure 6:
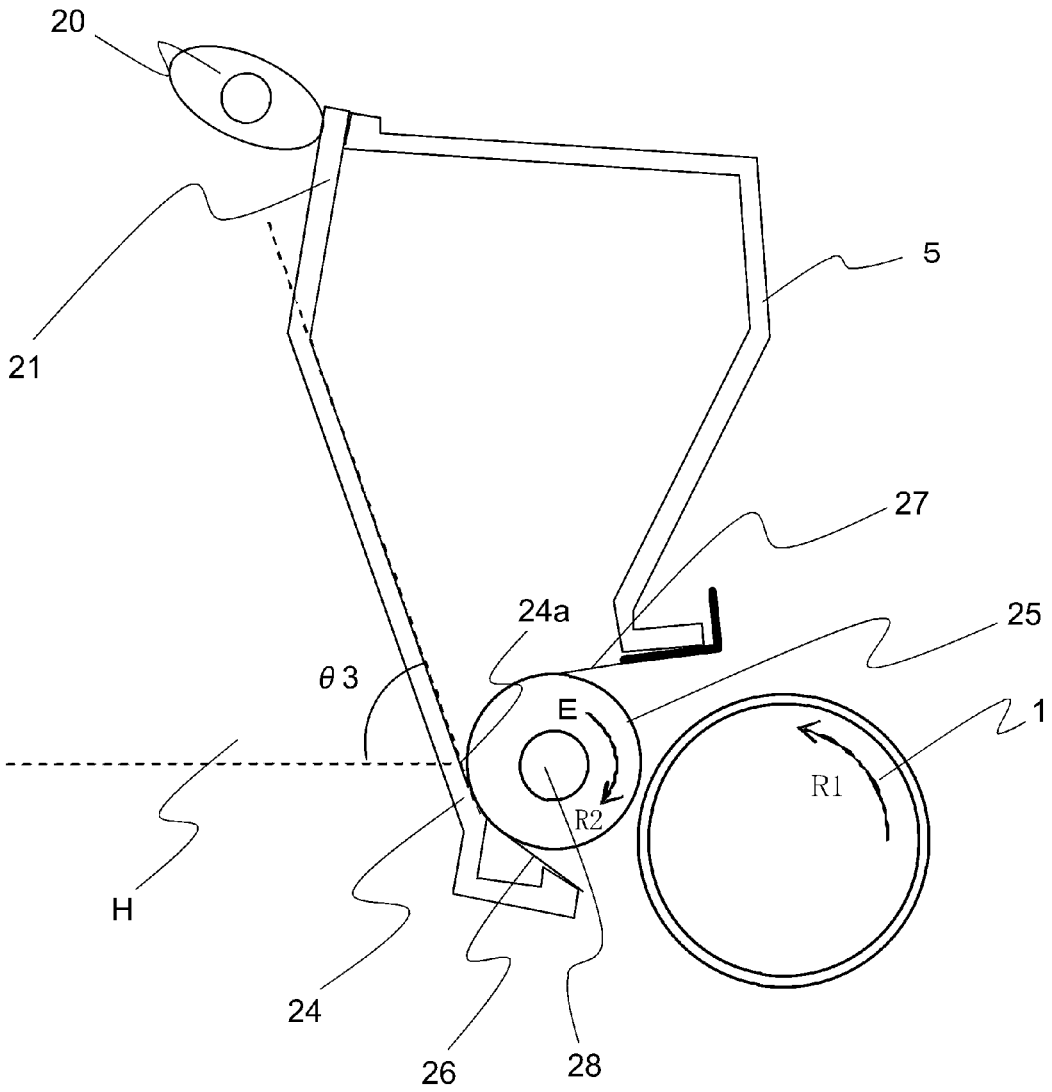
FIG. 6 is a schematic sectional view of the developing device, and is for describing the structure of the developing device.

That is, the developing device 5 was structured so that when the developing device 5 was in the position in which the development roller 25 remained in contact with the photosensitive drum 1 (position of contact, first position) as shown in FIG. 1, the angle between the slanted surface 24*a* and horizontal plane H became no more than 90 degrees and no less than the angle of repose, as shown in FIG. 1, whereas as the developing device 5 was moved into the position (separation position, second position) in which the development roller 25 was kept separated from the photosensitive drum 1 by the cam 20 as shown in FIG. 6, the angle θ between the slanted surface 24*a* and horizontal plane H changed from θ1 to θ3 (θ3>θ1). The angle θ3 also was no more than 90 degrees and no more than the angle of repose.

In a case, however, where there is a sufficient length of time for the development roller 25 to be supplied with toner, while the developing device 5 is in the attitude for development, before the starting of a development operation, the angle θ1 may be set irregardless of the attitude of the developing device 5. That is, all that is necessary is that the angle of the slanted surface 24*a* is no more than 90 degrees and no less than the angle of repose, at least when the developing device 5 is in the state in which the development roller 25 is in contact with the photosensitive drum 1 (state in which latent image formed on photosensitive drum 1 can be developed by development roller 25).

Further, in this embodiment, the development roller 25 is positioned at the opening of the developer container 21, which is at the bottom of the developer container 21. Thus, as the toner in the developer container 21 is moved downward out of the developer container 21 by its own weight, it is guided by the toner guiding member 24 to the toner supply position D. However, this embodiment is not intended to limit the present invention in terms of the positional relationship between the developer container 21 (toner storage portion) and development roller 25. That is, all that is necessary is that the developing device 5 is structured so that the toner in the developer container 21 is moved toward the development roller 25 (development chamber in which development roller 25 is positioned), and then, is guided to the toner supply position D by the slanted surface 24*a* of the toner guiding member 24 as it is slid downward along the slanted surface 24*a* by its own weight. For example, the developing device 5 may be structured so that the toner storage portion is below the development roller 25.

Also in this embodiment, the slanted surface 24*a* of the toner guiding member 24 is flat. However, this embodiment is not intended to limit the present invention in terms of the shape of the toner guiding member 24. For example, the present invention is also applicable to a developing device, the portion of which corresponding to the slanted surface 24*a* is curved in cross-section, at a plane perpendicular to the axial line of the development roller 25. In such a case, the angle θ1 is the angle between the tangential line of the curved surface (24*a*) and horizontal plane H.

Further, in this embodiment, the toner guiding member 24 is a part of the developer container 21. However this embodiment is not intended to limit the present invention in terms of developing device structure. That is, the present invention is also applicable to a developing device structured so that its toner guiding member is a part of the frame of the developing device.

Further, in this embodiment, the developing device 5 and photosensitive drum 1 are integral parts of the process cartridge 7 which is removably installable in the main assembly of the image forming apparatus. That is, the developing device 5 is removably mountable in the main assembly of the image forming apparatus. This embodiment, however, is not intended to limit the present invention in terms of the structure of an image forming apparatus. That is, the present invention is also applicable to an image forming apparatus structured so that its developing device (5) is a part of a process cartridge which is removably installable in the main assembly of the image forming apparatus, but does not include the photosensitive drum 1. Further, the present invention is also applicable to an image forming apparatus structured so that its developing device (5) is fixed to the main assembly of the image forming apparatus, being therefore not installed into, or removed from, the main assembly by a user.

[Embodiment 2]

Next, the second embodiment of the present invention is described.

This embodiment is characterized in that a flexible sheet (which hereafter will be referred to simply as sheet 30) having a toner guiding surface 30*a* is employed as the toner guiding member. Incidentally, hereafter, only the structural components of the developing device in this embodiment, which are different from the counterparts in the first embodiment, will be described. That is, the structural components which are the same as the counterparts in the first embodiment will not be described.

Figure 5:
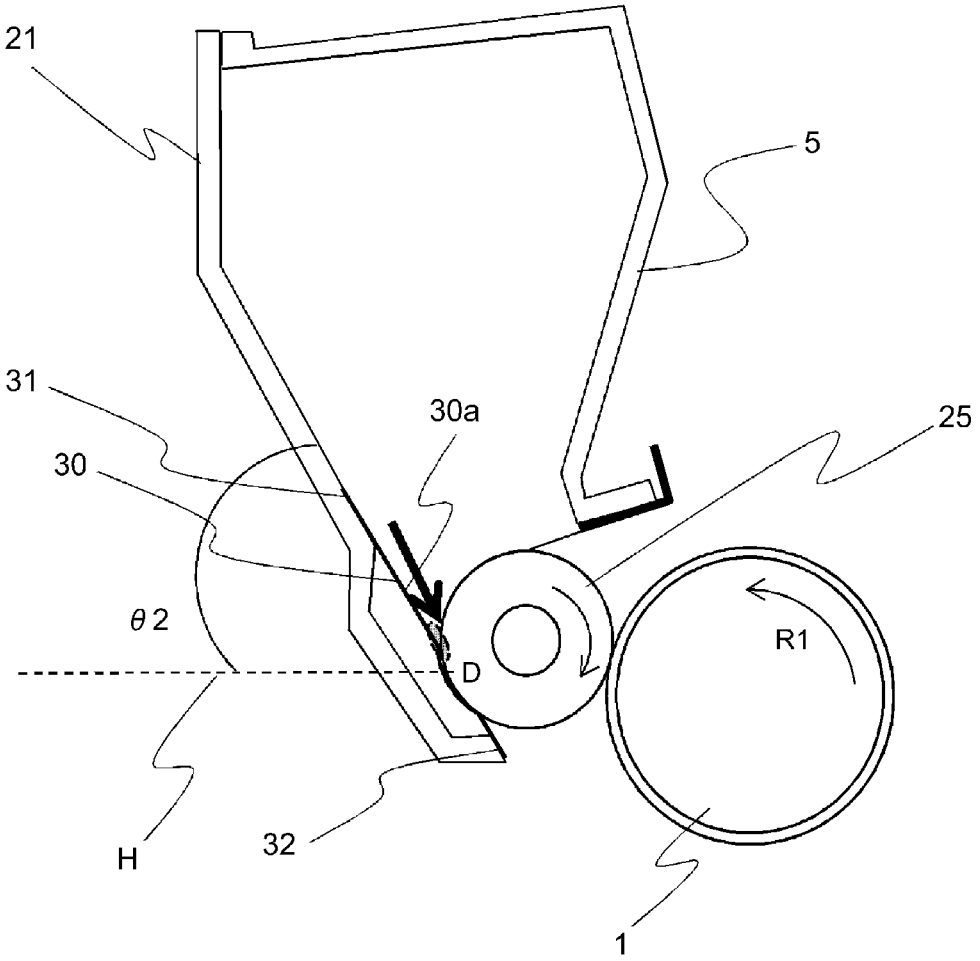
FIG. 5 is a schematic sectional view of the developing device in the second embodiment of the present invention, and is for describing the structure of the developing device.

FIG. 5 is a schematic sectional view of the portions of the developing device 5 in this embodiment, which are essential to the description of the structure of the developing device 5. Referring to FIG. 5, the developing device 5 is structured so that the sheet 30 remains in contact with the peripheral surface of the development roller 25, in the toner supply position. The top edge portion of the sheet 30 is fixed to the inward surface 31 of the developer container 21, whereas the bottom edge portion of the sheet 30 is fixed to the sheet seat 32 of the developer container 21. The amount of apparent intrusion of the sheet 30 into the development roller 25 is 0.1 mm.

The developing device 5 in this embodiment is structured so that the angle θ2 between the horizontal plane H and the toner guiding surface 30*a* becomes 70 degrees, which is no less than the angle of repose of toner. The substance used as the material for the sheet 30 in this embodiment is polyester film which is 0.1 mm in thickness.

As the development roller 25 and sheet 30 are pressed upon each other, the sheet 30 is made to recess in the opposite direction from the development roller 25. However, the sheet 30 is flexible. Therefore, it does not occur that the development roller 25 is excessively stressed by the sheet 30. Thus, it does not occur with elapse of time that the development roller 25 is deteriorated by the sheet 30.

Thus, not only can this embodiment provide the same effect as the first embodiment, but also, it can prevent the problem that the development roller 25 is deteriorated by a toner guiding member with the elapse of time. Therefore, it can lengthen a developing device in service life, compared to the first embodiment.

In this embodiment, the material for the sheet 30 was polyester film. This embodiment, however, is not intended to limit the present invention in terms of the material for the sheet 30. That is, the present invention is also applicable to a developing device, the sheet 30 of which is made of polyphenyl sulfide film, polyethylene terephthalate film, or the like. Further, the sheet 30 was 0.1 mm in thickness. This embodiment, however, is not intended to limit the present invention in terms of the thickness of the sheet 30. All that is necessary for the present invention to be applicable to a developing device is that the thickness of the sheet 30 of the developing device is such that as the development roller 25 is pressed upon the sheet 30, the sheet 30 is bent by the development roller 25.

Further, in this embodiment, the developing device was reduced in size and component count by making the sheet 30, as a toner guiding member, double as a seal (which is equivalent to toner leak prevention seal 26 in first embodiment) which covers the gap between the development roller 25 and developer container 21. This embodiment, however, is not intended to limit the present invention in terms of developing device structure. For example, the present invention is also applicable to a developing device provided with a sealing member, such as the sealing member 26 in the first embodiment, in addition to the sheet 30.

Further, in the first and second embodiments, there was not provided a toner stirring member in the developer container 21. These embodiments, however, are not intended to limit the present invention in terms of the presence (or absence) and location of the toner stirring member. That is, the present invention is also applicable to a developing device, the toner stirring member of which is in the developer container 21.

Lastly, the above described effects of each of the preceding embodiments of the present invention may be summarized as follows. That is, the primary object of the present invention is to increase a developing device in the ratio of the developer in its developer container, which is actually usable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 097599/2013 and 079686/2014 filed May 7, 2013 and Apr. 8, 2014, respectively, which are hereby incorporated by reference.

What is claimed is:

1. A developing device usable with an image forming apparatus, comprising:

a developer carrying member for carrying a developer;

a developer accommodating portion for accommodating a developer and having an inclined surface contacting said developer carrying member, said inclined surface being effective to guide a developer to a contact portion where the inclined surface contacts said developer carrying member to cause the developer to be carried on said developer carrying member; and a regulating member for regulating an amount of the developer carried on said developer carrying member, wherein an inclination angle of said inclined surface is in a range not less than an angle of rest of the developer and less than 90 degrees.

2. A developing device according to claim 1, further comprising an accommodating portion, provided above said developer carrying member, for accommodating the developer, wherein said guiding member guides the developer moving from said accommodating portion by a weight thereof to the contact portion.

3. A developing device according to claim 1, wherein said developing device is movable between a first position for contacting said developer carrying member to said image bearing member and a second position for spacing said developer carrying member from said image bearing member, wherein the inclination angle satisfies the range when said developing device is in the first position.

4. A developing device according to claim 3, wherein the angle of rest satisfies the range when said developing device is in the first position and when said developing device is in the second position.

5. A developing device according to claim 1, wherein said guiding member is a part of a frame of said developing device.

6. A developing device according to claim 1, wherein said guiding member includes a flexible sheet.

7. A developing device according to claim 1, wherein said regulating member regulates the amount of the developer above the contact portion.

8. A developing device according to claim 1, wherein said developer is a non-magnetic one component developer.

9. A developing device according to claim 1, wherein said developer is a spheroidized developer.

10. A developing device according to claim 1, wherein said developing device is detachably mountable relative to a main assembly of the image forming apparatus.

11. A process cartridge detachably mountable to a main assembly of an image forming apparatus;

an image bearing member for bearing a latent image;

a developer carrying member for carrying a developer to be supplied to said image bearing member;

a developer accommodating portion for accommodating a developer and having an inclined surface contacting said developer carrying member, said inclined surface being effective to guide the developer to a contact portion where the inclined surface contacts said developer carrying member;

a regulating member for regulating an amount of the developer carried on said developer carrying member, wherein an inclination angle of said inclined surface is in a range not less than an angle of rest of the developer and less than 90 degrees.

12. A process cartridge according to claim 11, further comprising an accommodating portion, provided above said developer carrying member, for accommodating the developer, wherein said guiding member guides the developer moving from said accommodating portion by a weight thereof to the contact portion.

13. A process cartridge according to claim 11, further comprising a developing device including said developer carrying member and said developer accommodating portion and movable relative to said image bearing member between a first position for contacting said developer carrying member to said image bearing member and a second position for spacing said developer carrying member from said image bearing member, wherein the inclination angle satisfies the range when said developing device is in the first position.

14. A process cartridge according to claim 13, wherein the angle of rest satisfies the range when said developing device is in the first position and when said developing device is in the second position.

15. A process cartridge according to claim 11, wherein said guiding member is a part of a frame of said accommodating portion.

16. A process cartridge according to claim 11, wherein said guiding member includes a flexible sheet.

17. A process cartridge according to claim 11, wherein said regulating member regulates the amount of the developer above the contact portion.

18. An image forming apparatus for forming an image on a recording material, comprising:

an image bearing member for bearing a latent image;

a developer carrying member for carrying a developer to be supplied to said image bearing member;

a developer accommodating portion for accommodating a developer and having an inclined surface contacting said developer carrying member, said inclined surface being effective to guide a developer to a contact portion where the inclined surface contacts said developer carrying member to cause the developer to be carried on said developer carrying member; and a regulating member for regulating an amount of the developer carried on said developer carrying member, wherein an inclination angle of said inclined surface is in a range not less than an angle of rest of the developer and less than 90 degrees.

* * * * *